US008545272B2

(12) United States Patent
Lee et al.

(10) Patent No.: US 8,545,272 B2
(45) Date of Patent: Oct. 1, 2013

(54) ELECTRICAL CONNECTOR WITH SEPARATING EXTENSIONS ON TERMINALS

(75) Inventors: Kuo-Chi Lee, New Taipei (TW); Chin-Huang Lin, New Taipei (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 13/227,251

(22) Filed: Sep. 7, 2011

(65) Prior Publication Data

US 2013/0059461 A1 Mar. 7, 2013

(51) Int. Cl.
*H01R 24/00* (2011.01)

(52) U.S. Cl.
USPC ..... 439/637

(58) Field of Classification Search
USPC ..... 439/74, 79, 620.22, 374, 751
See application file for complete search history.

(56) References Cited

U.S. PATENT DOCUMENTS 3,348,191 A * 10/1967 Kinkaid ..... 439/637
5,842,875 A * 12/1998 Yagi ..... 439/74
6,790,054 B1 * 9/2004 Boonsue ..... 439/79
7,144,277 B2 * 12/2006 Pan et al. ..... 439/660
7,381,097 B2 * 6/2008 Ellis et al. ..... 439/676
7,524,206 B2 * 4/2009 Gutierrez et al. ..... 439/607.01
7,632,157 B2 * 12/2009 Imai ..... 439/751
7,641,508 B2 * 1/2010 Chen et al. ..... 439/500
8,128,433 B2 * 3/2012 Schempp et al. ..... 439/620.22
2007/0173103 A1 * 7/2007 Ellis et al. ..... 439/404

* cited by examiner

*Primary Examiner* — Chandrika Prasad
(74) *Attorney, Agent, or Firm* — Muncy, Geissler, Olds & Lowe, PLLC

(57) ABSTRACT

An anti-electromagnetic interference electrical connector having a terminal assembly is provided. The anti-EMI electrical connector includes an electrical insulation case, plural first terminals, and plural second terminals. The electrical insulation case includes a slot. Each first terminal is disposed in the electrical insulation case and includes a contact end located in the slot. Each second terminal is disposed in the electrical insulation case and in a staggered manner with the first terminals. Each second terminal includes a body and a first extended portion. The body is located in the electrical insulation case and includes a connection end located in the slot. The first extended portion extends from the body and an included angle is defined between the first extended portion and the body. The first extended portion isolates the first terminals adjacent to each of the second terminals by increasing a lateral projected area of the second terminal.

14 Claims, 12 Drawing Sheets

ELECTRICAL CONNECTOR WITH SEPARATING EXTENSIONS ON TERMINALS

BACKGROUND

1. Technical Field

This disclosure relates to an electrical connector, and more particularly to an anti-electromagnetic interference electrical connector and a terminal assembly thereof.

2. Related Art

In an electrical connector in the art, for example, in a double data rate (DDR) connector, the arrangement of the terminals is to arrange signal terminals and the ground terminals in a staggered manner. Each signal terminal transfers a signal through a current flow, when the current flows to transfer data through the signal terminal; a magnetic field is generated around the signal terminal. Furthermore, in the electrical connector, the number of the small-sized terminals is enormous, resulting in a very small gap between the terminals. As a result, when the signal terminals generate the magnetic field, an EMI phenomenon occurs, which affects the transfer efficiency between the signal terminals. This has therefore become a subject to be solved in this field.

A signal terminal performs signal transmission through high-frequency current switching. Therefore, when a high-frequency current passes through the signal terminal and is switched rapidly, a magnetic field is generated around the signal terminal.

In an electrical connector in the art, the number of the small-sized signal terminals is enormous, resulting in a very small pitch between the terminals. When the signal terminals generate the magnetic field, the EMI phenomenon is likely to occur between the adjacent signal terminals, causing a transmission error and affecting a transmission efficiency of the signal terminals.

In order to eliminate the EMI phenomenon between the adjacent terminals, taking a DDR connector as an example, a terminal arrangement manner thereof is to arrange the signal terminals and the ground terminals in a staggered manner with intervals, so that the ground terminals shield the EMI between the adjacent signal terminals. However, these ground terminals can only shield the EMI to a limited degree; if the arrangement of the terminals is more intensive, a shielding effect of the ground terminals is very limited.

SUMMARY

Accordingly, this disclosure provides an anti-electromagnet interference (EMI) electrical connector and a terminal assembly thereof, so as to eliminate EMI between terminals.

At least one embodiment of this disclosure provides an anti-electromagnetic interference (anti-EMI) electrical connector. The anti-EMI electrical connector includes an electrical insulation case, a plurality of first terminals, and a plurality of second terminals.

The electrical insulation case includes a slot. The first terminals are respectively disposed in the electrical insulation case, and each of the first terminals respectively includes a contact end located in the slot. The second terminals are disposed in the electrical insulation case, and the second terminals and the first terminals are arranged in a staggered manner. Each of the second terminals respectively includes a body and a first extended portion. The body is located in the electrical insulation case and the body includes a connection end located in the slot.

The first extended portion extends from the body and an included angle is defined between the first extended portion and the body. The first extended portion isolates the first terminals adjacent to each of the second terminals by increasing a lateral projected area of the second terminal.

At least one embodiment of this disclosure further provides a terminal assembly. The terminal assembly is provided to be combined with an electrical insulation case, so as to form an anti-EMI electrical connector. The terminal assembly includes a fixing seat, a plurality of first terminals and a plurality of second terminals.

The first terminals are fixed on the fixing seat, and each of the first terminals respectively includes a contact end. The second terminals are fixed on the fixing seat, and the second terminals and first terminals are arranged in a staggered manner. Each of the second terminals respectively includes a body and a first extended portion. The body is located in the electrical insulation case, and the first extended portion extends from the body and an included angle is defined between the first extended portion and the body. The first extended portion isolates the first terminals adjacent to each of the second terminals by increasing a lateral projected area of the second terminal.

In this disclosure, the lateral projected area of each of the second terminals is increased by the first extended portion, thereby effectively increasing an effective shielding area of each of the second terminals and improving electrical characteristics to isolate the first terminals adjacent to each of the second terminals. When two first terminals separated by the same second terminal transfer data, the second terminal provides the effective shielding effect to suppress the EMI and maintain the quality of electronic signals.

Preferred embodiments and functions of this disclosure will become apparent from the accompanying drawings given hereinafter.

BRIEF DESCRIPTION OF THE DRAWINGS

This disclosure will become more fully understood from the detailed description given herein below for illustration only, and thus not limitative of this disclosure, wherein.

DETAILED DESCRIPTION

Figure 1:
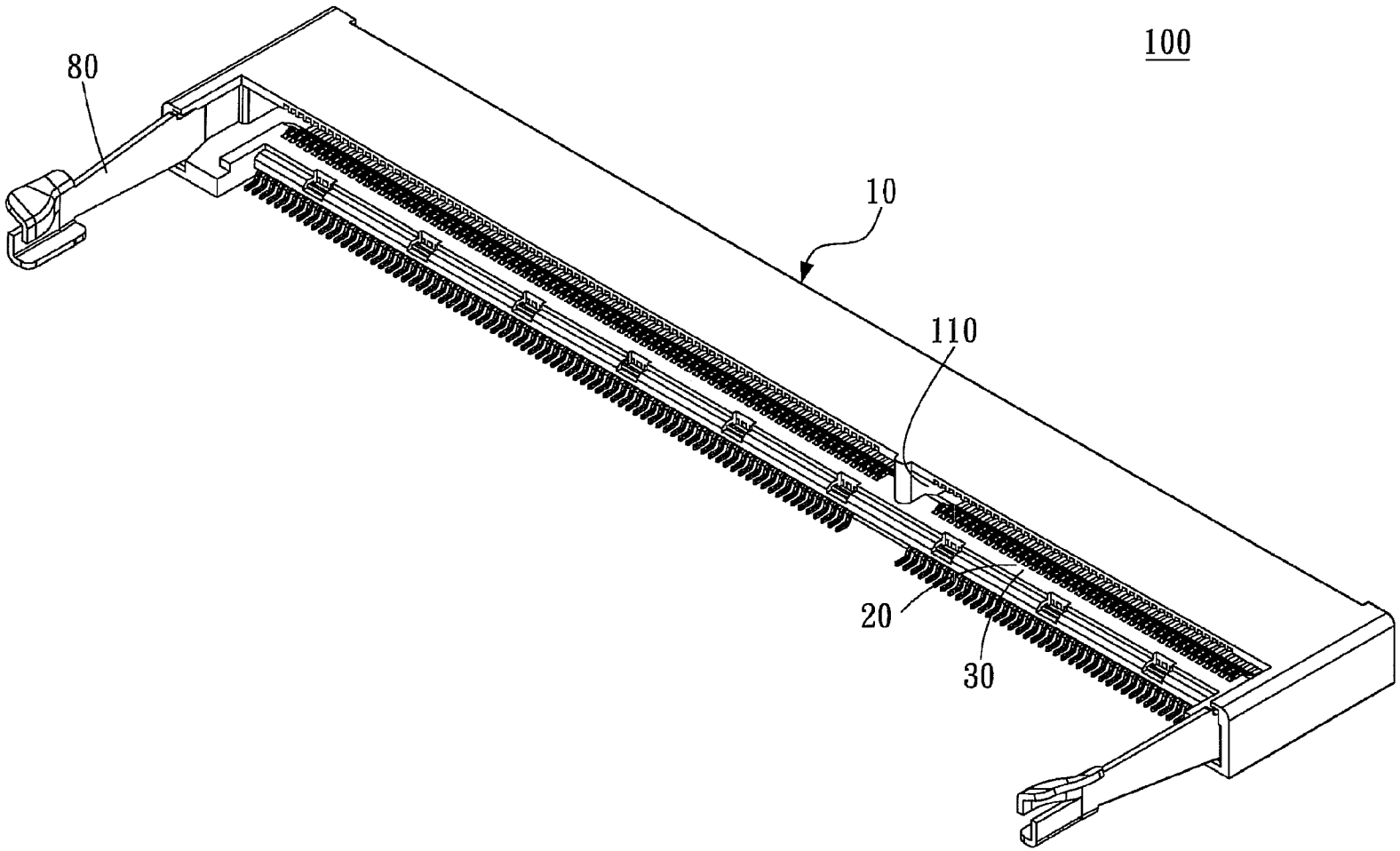
FIG. 1 is a perspective view of a first embodiment.
Figure 2:
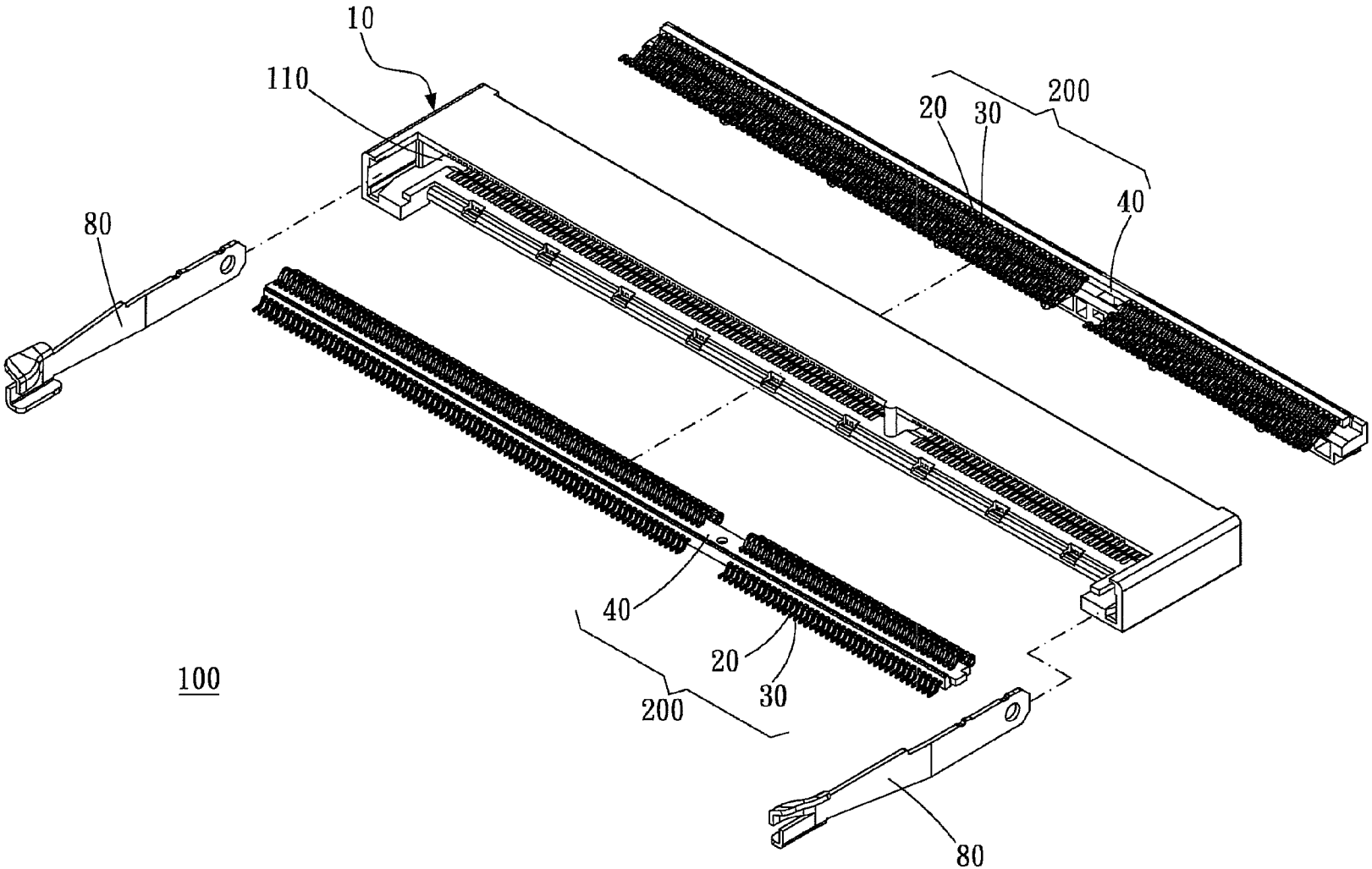
FIG. 2 is an exploded view of the first embodiment.

Please refer to FIG. 1 and FIG. 2, an anti-electromagnetic interference (anti-EMI) electrical connector 100 according to a first embodiment is provided to be electrically connected to an electrical plug (not shown). The anti-EMI electrical connector 100 includes an electrical insulation case 10, a plurality of first terminals 20, and a plurality of second terminals 30.

Please refer to FIG. 1 and FIG. 2, the electrical insulation case 10 includes a slot 110, and the above-mentioned electrical plug is provided to be inserted into the slot 110. Take a DDR memory module as an example of the electrical connector 100, the slot 110 is figured in a slim shape, and the electrical plug is in a flat shape that matches the slot 110 and is located at an edge of a memory module.

Figure 3:
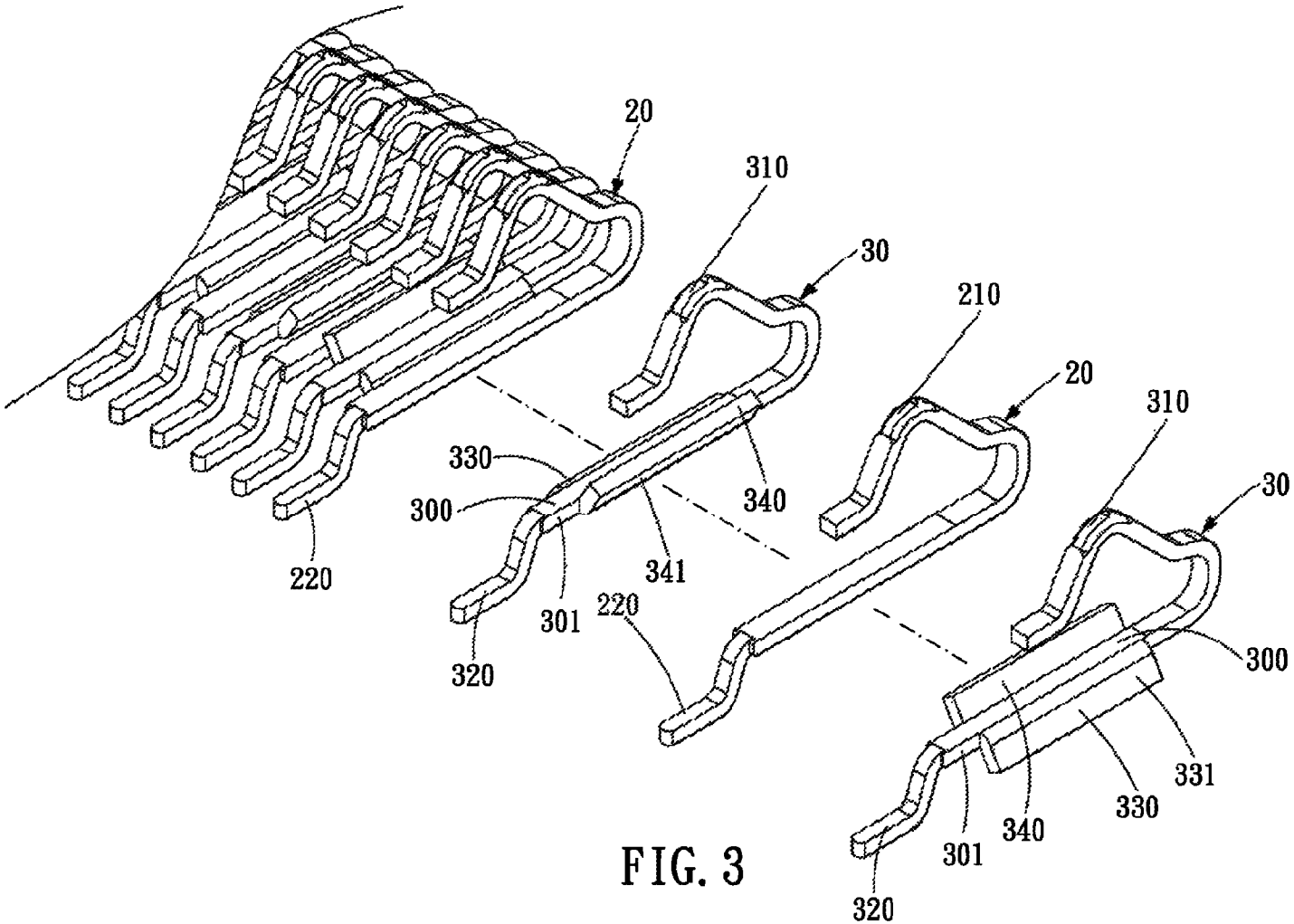
FIG. 3 is a perspective view of terminals in the first embodiment.

Please refer to FIG. 1, FIG. 2 and FIG. 3, the first terminals 20 are disposed in the electrical insulation case 10. Each of the first terminals 20 respectively includes a contact end 210. The contact ends 20 are located in the slot 110 of the electrical insulation case 10. The first terminals 20 in this embodiment are used for signal transmission; in other words, each first terminal 20 is a signal terminal.

The first terminal 20 further includes a first welding end 220. The first welding end 220 is provided to be welded on a circuit board, such as a computer motherboard, so that the electrical connector 100 is fixed on the circuit board through the first welding end 220 of the first terminals 20 and is further electrically connected to the circuit board. As shown in FIG. 2, the first terminals 20 provided to be combined with the electrical insulation case 10 through the fixing seat 40, but this disclosure is not limited hereto. In one or more embodiments, the first terminals 20 are combined with the electrical insulation case 10 in another combination manner (such as interference or clipping), that is, the fixing seat 40 is omitted.

Please refer to FIG. 1, FIG. 2 and FIG. 3, the second terminals 30 are disposed in the electrical insulation case 10. The second terminals 30 and the first terminals 20 are arranged in a staggered manner. In other words, the second terminals 30 and the first terminals 20 are staggered by one first terminal 20 followed by one second terminal 30.

Each of the second terminals 30 respectively includes a body 300 and a first extended portion 330. The body 300 is located in the electrical insulation case 10, and the body 300 includes a connection end 310 located in the slot 110 of the electrical insulation case 10. The first extended portion 330 extends from one side surface 301 of the body 300 and an included angle θ is defined between a widest surface 331 of the first extended portion 330 and a longitudinal axis of the body 300. The first extended portion 330 is provided to increase a lateral projected area of the second terminal 30, so as to isolate the two first terminals 20 adjacent to each of the second terminals 30. Here, the first extended portion 330 is located on one side of the body 300 without contacting the adjacent first terminals 20. It is noted that the number of the second terminals 30 corresponds to the number of the first terminals 20, or the number of the second terminals 30 is greater than, equal to, or smaller than the number of the first terminals 20.

An arrangement example of the number of the first terminals 20 and the second terminals 30 actually in use is to have the first terminals 20 or the second terminals 30 located on the most outer side, but this disclosure is not limited hereto. The first extended portion 330 may be located between two first terminals 20 or located on one lateral side of one first terminal 20. As shown in FIG. 2, the second terminals 30 are combined with the electrical insulation case 10 through the fixing seat 40, but this disclosure is not limited hereto. The second terminals 30 may also be combined with electrical insulation case 10 in another combination manner (such as interference or clipping), that is, the fixing seat 40 is omitted, which is particularly explained herein.

Figure 4:
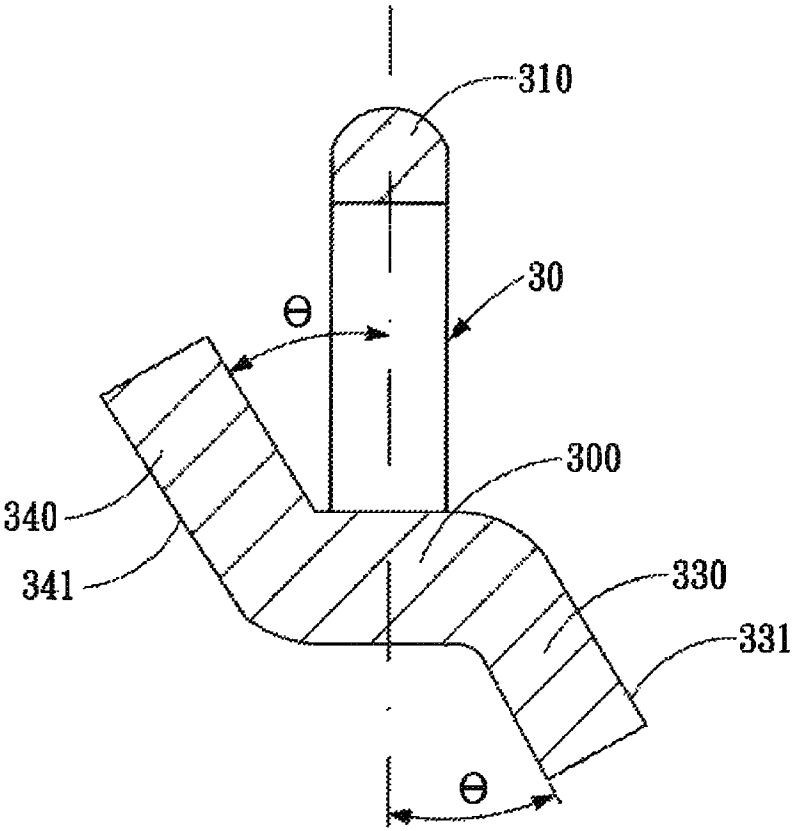
FIG. 4 is a cross-sectional view of the second terminal of the first embodiment.

Please refer to FIG. 3 and FIG. 4, in an example of the embodiment, each second terminal 30 is a ground terminal. The second terminal 30 further includes a second extended portion 340 extending from the body 300 and corresponding to the first extended portion 330. Another included angle θ is defined between a widest surface 341 of the second extended portion 340 and a longitudinal axis of the body 300, as shown in FIG. 4.

The first extended portion 330 and the second extended portion 340 may be preferably formed in a manner that the first extended portion 330 and the second extended portion 340 are reserved when a metal sheet is punched to form the second terminals 30, and the first extended portion 330 and the second extended portion 340 are respectively bent to form an angle with an ironworking tool, so that the first extended portion 330 and the second extended portion 340 are extend from the body 300 and respectively define an included angle θ with the body 300. The first extended portion 330 and the second extended portion 340 may be bent in the same direction (both upwards and downwards), or opposite directions (one upwards and the other downwards).

Similar to the first terminal 20, the second terminal 30 further includes a second welding end 320. The second welding end 320 is provided to be welded on the circuit board, such as the computer motherboard, so that the electrical connector is fixed on the circuit board by the second welding end 320 of the second terminal 30, and the second terminal 30 is connected to a grounding circuitry of the circuit board, so that the second terminal 30 is electrically grounded.

As shown in FIG. 3, when observed from the lateral side, the first extended portion 330 and the second extended portion 340 expand the lateral projected area of the second terminal 30. The first extended portion 330 and the second extended portion 340 therefore increase an effective shield area and improve electrical characteristics. Therefore, so when the first terminal 20 performs data transmission, the EMI of each first terminal 20 is blocked by the first extended portion 330 and the second extended portion 340, thereby maintaining the quality of the electronic signals.

As shown in FIG. 1 and FIG. 2, the electrical connector 100 of this embodiment further includes a positioning member 80, disposed in the electrical insulation case 10 for positioning and latching the electrical plug. When the electrical plug is inserted into the slot 110 and is electrically connected to the contact end 210 and the connection end 310, the positioning member 80 fixes the electrical plug 90.

Figure 5:
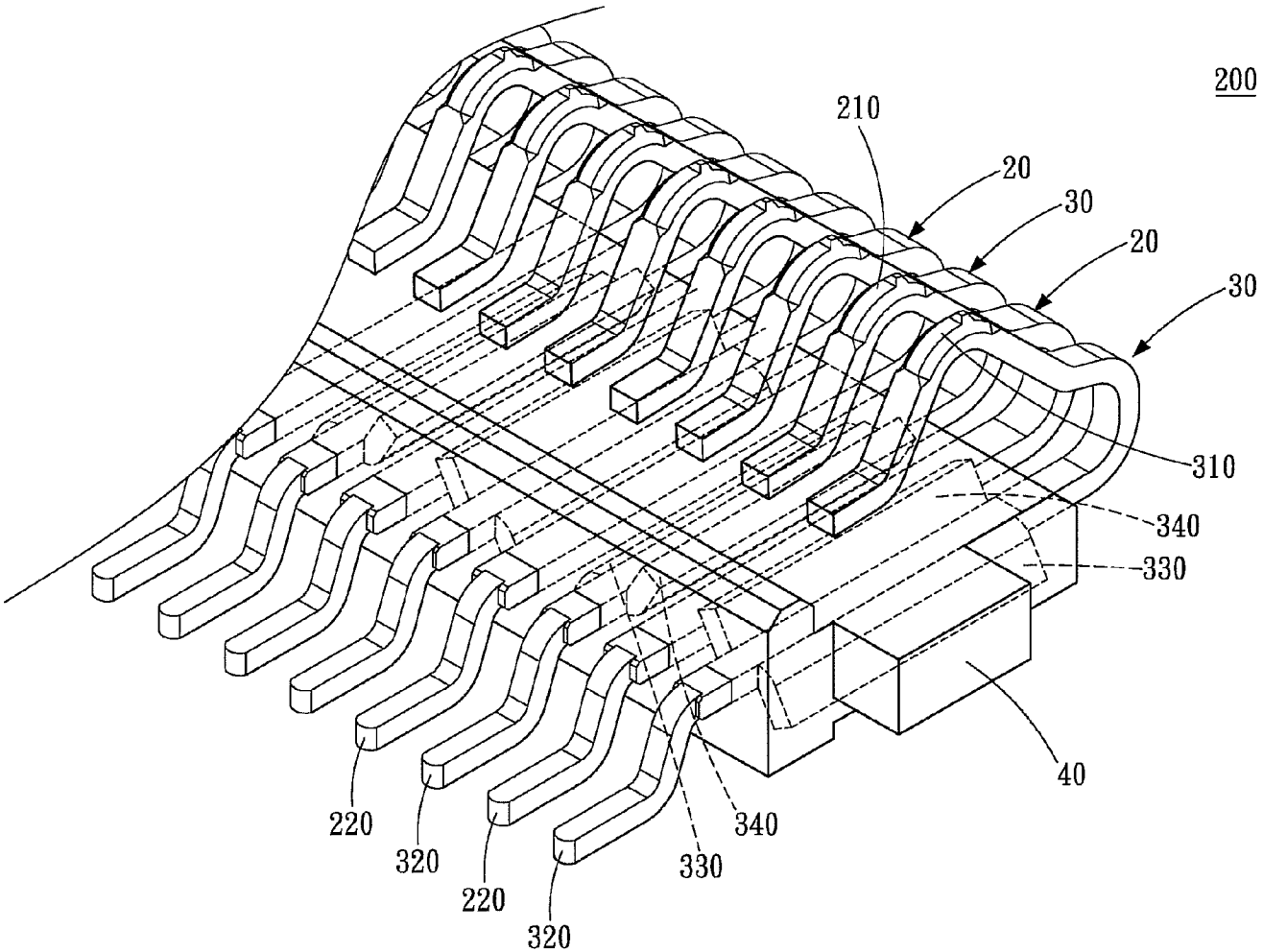
FIG. 5 is a cross-sectional view of a second embodiment.

In FIG. 5, a terminal assembly 200 according to a second embodiment is shown. The terminal assembly 200 is provided to be combined with electrical insulation case 10, so as to form an anti-EMI electrical connector 100. The terminal assembly 200 includes a fixing seat 40, a plurality of first terminals 20 and a plurality of second terminals 30.

As shown in FIG. 5, the first terminals 20 are fixed on the fixing seat 40, and each of the first terminals 20 respectively includes a contact end 20. The p second terminals 30 are fixed on the fixing seat 40, and the second terminals 30 and the first terminals 20 are arranged in a staggered manner. Each of the second terminals 30 respectively includes a body 300 and a first extended portion 330. The first extended portion 330 extends from the body 300 and an included angle is defined between the first extended portion 330 and the body 300. The first extended portion 330 isolates the first terminals 20 adjacent to each of the second terminals 30 by increasing a lateral projected area of the second terminal 30.

In the implementations of the embodiment, the first terminals 20 and the second terminals 30 are combined with the fixing seat 40 in an insert molding manner. In more details, the first extended portion 330 is embedded in the fixing seat 40 in the insert molding manner.

Similar to the first embodiment, the second terminal 30 of the second embodiment also includes a second extended portion 340 extending from the body 300 and another included angle is defined between the second extended portion 340 and the body 300. The first extended portion 330 and the second extended portion 340 are bent in the same direction or opposite directions. In one or more embodiment, the second extended portion 340 is embedded in the fixing seat 40 in the insert molding manner.

Figure 6:
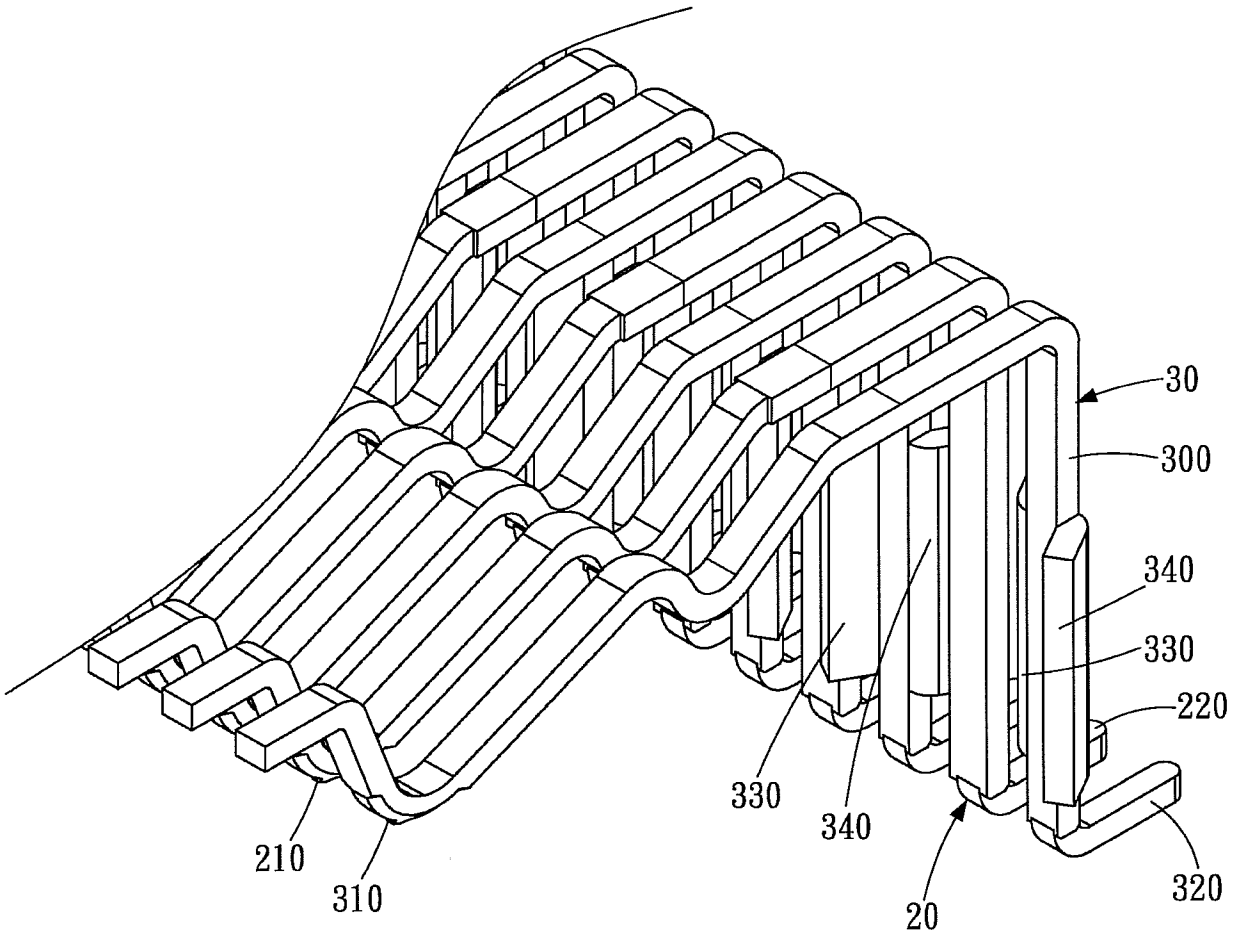
FIG. 6 is a perspective view of a third embodiment.
Figure 7:
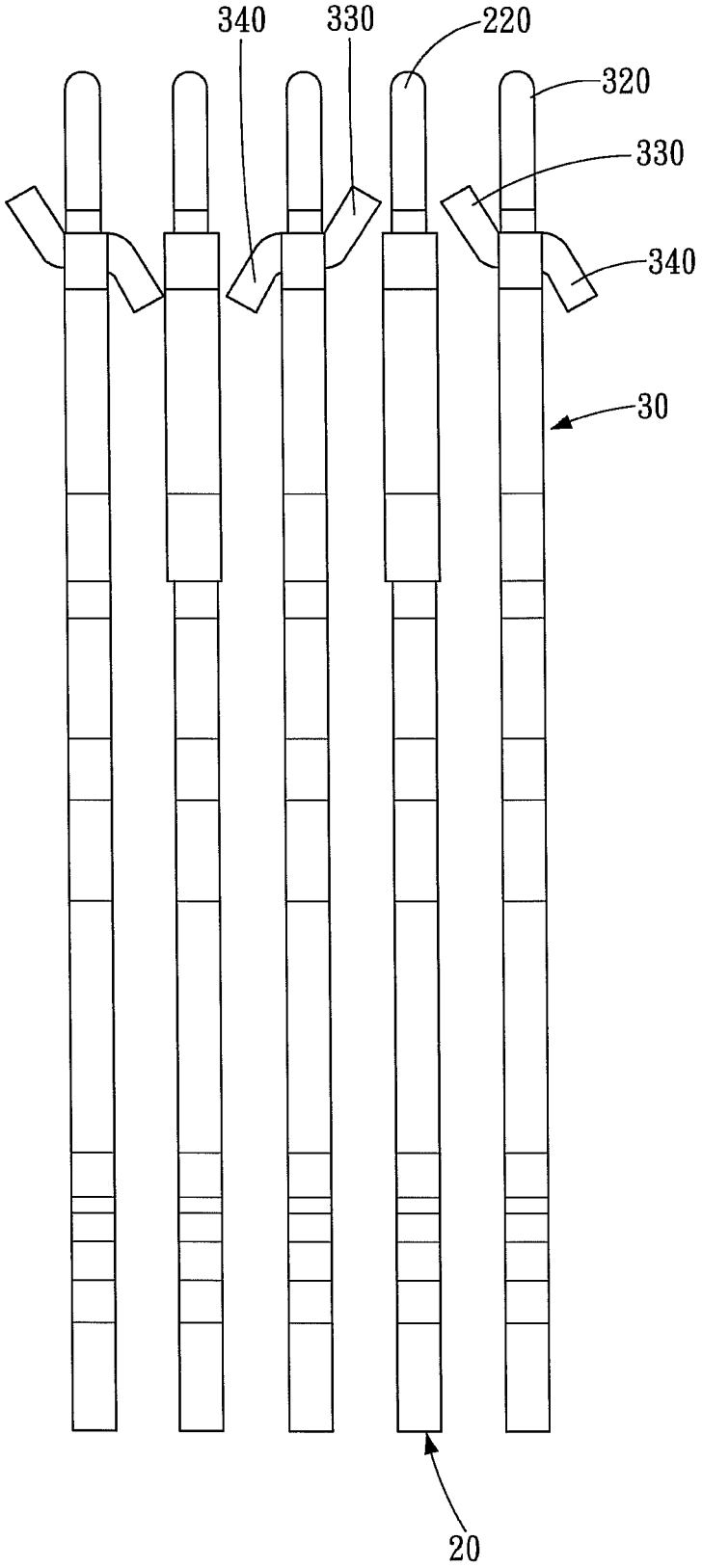
FIG. 7 is a top view of the third embodiment.

Please refer to FIG. 6 and FIG. 7, different configurations of the first terminals 20 and the second terminals 30 according to a third embodiment are provided, and may be alternatively applied in the first embodiment or the second embodiment. Although a different configuration is employed, the structure and the constitution of the first terminals 20 and the second terminals 30 of this embodiment are substantially the same as those of the first embodiment or the second embodiment. The first terminal 20 includes a contact end 210 and a first welding end 220, and the second terminal 30 includes a body 300, a connection end 310, a second welding end 320, a first extended portion 330 and a second extended portion 340.

Figure 8:
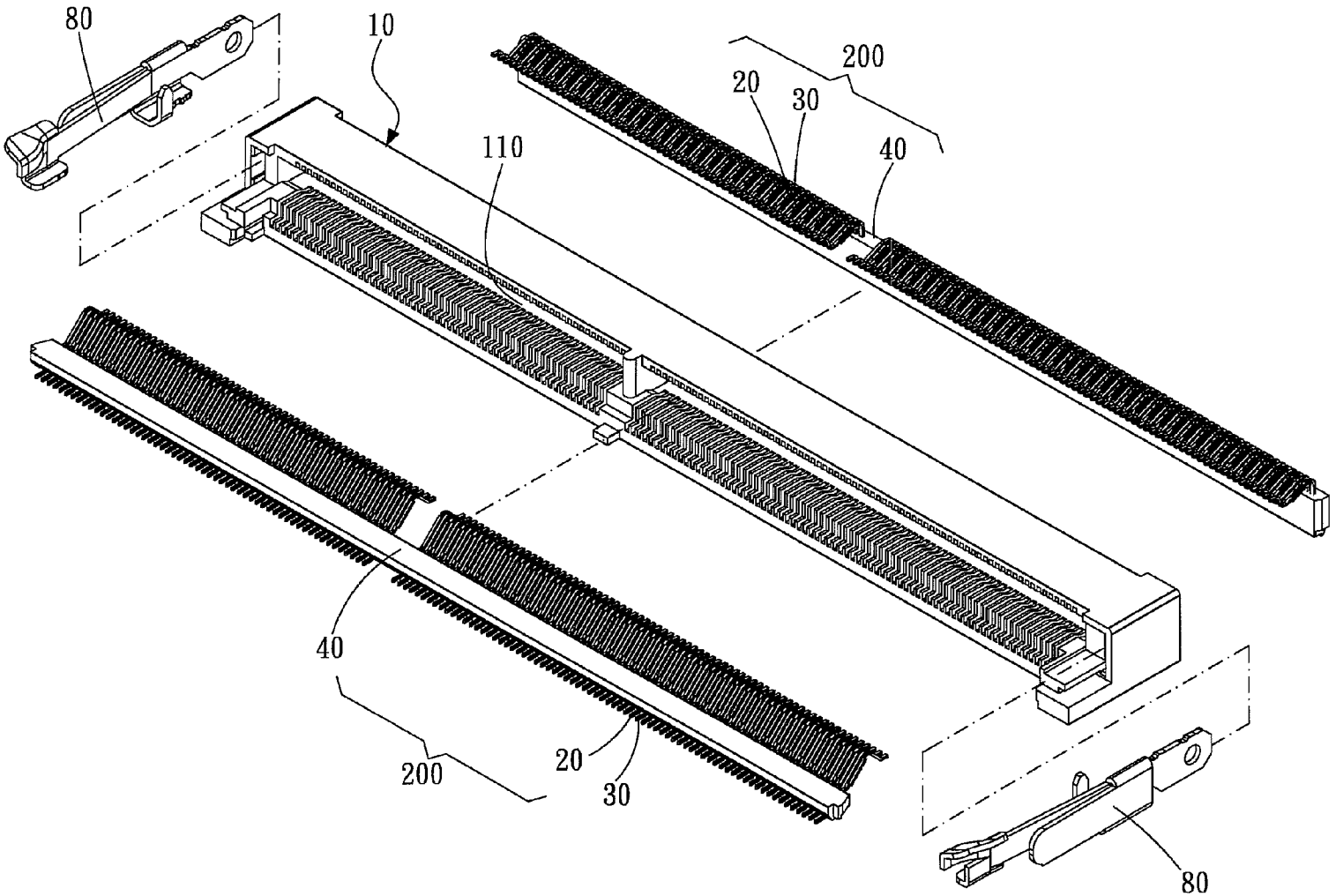
FIG. 8 is an exploded view of a fourth embodiment.
Figure 9:
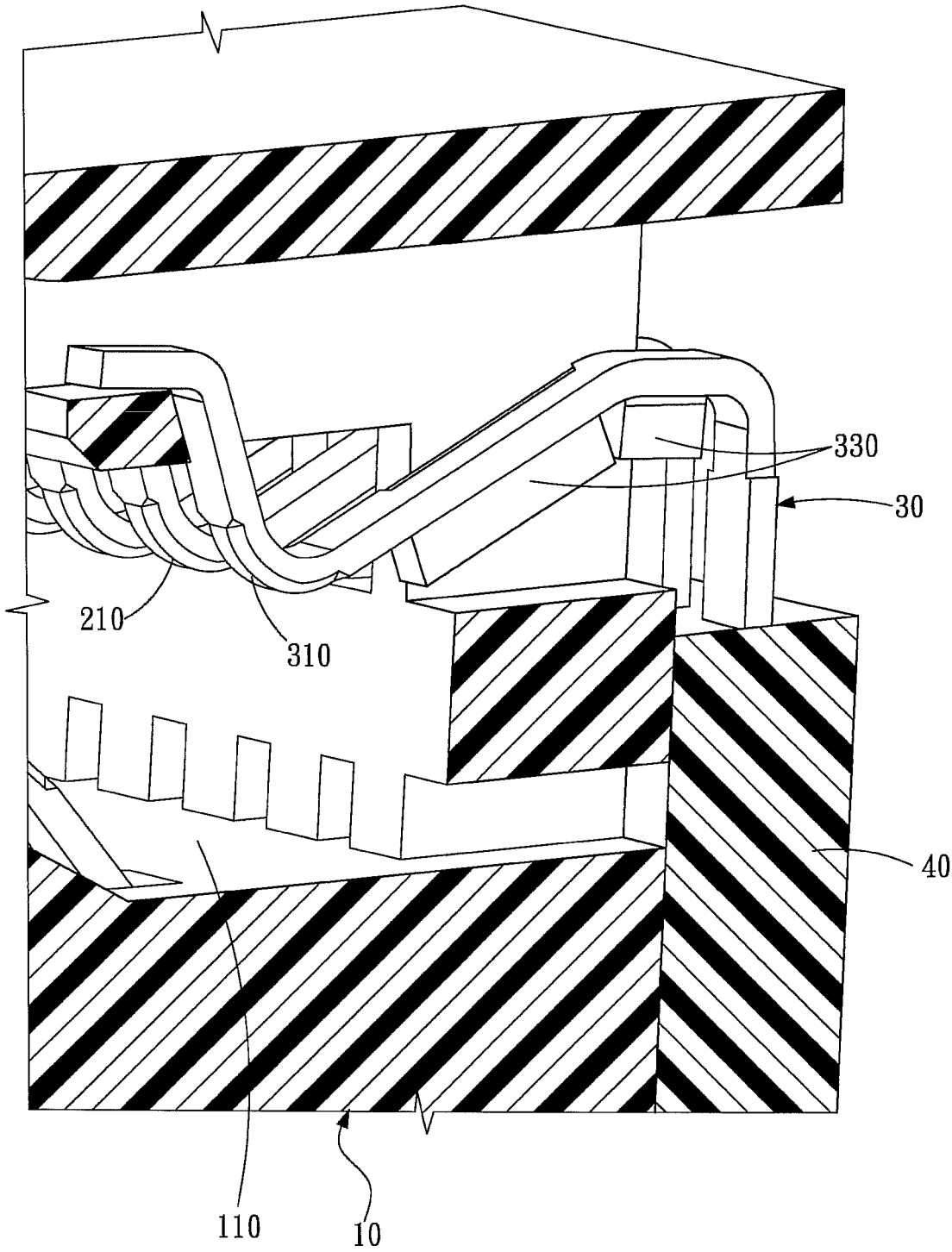
FIG. 9 is a side view of the fourth embodiment.
Figure 10:
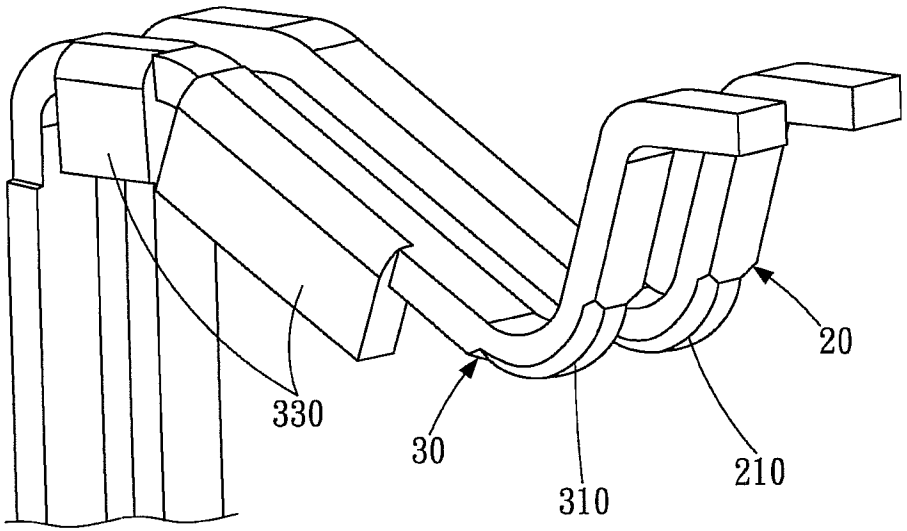
FIG. 10 is a perspective view of terminals in the fourth embodiment.

Please refer to FIG. 8, FIG. 9 and FIG. 10, an anti-EMI electrical connector 100 and a terminal assembly 200 according to a fourth embodiment are shown, which have substantially the same structure and constitution of the first, second and third embodiments. The first terminal 20 includes a contact end 210 and a first welding end 220, and the second terminals 30 includes a body 300, a connection end 310, a second welding end 320 and a first extended portion 330.

A major difference between the fourth embodiment and the first, the second and the third embodiment lies in the fact that the second extended portion 340 is omitted from the second terminal 30. Meanwhile, the first extended portion 330 is located in the slot 110 of the electrical insulation case 10 instead of being embedded in the fixing seat 40.

Figure 11:
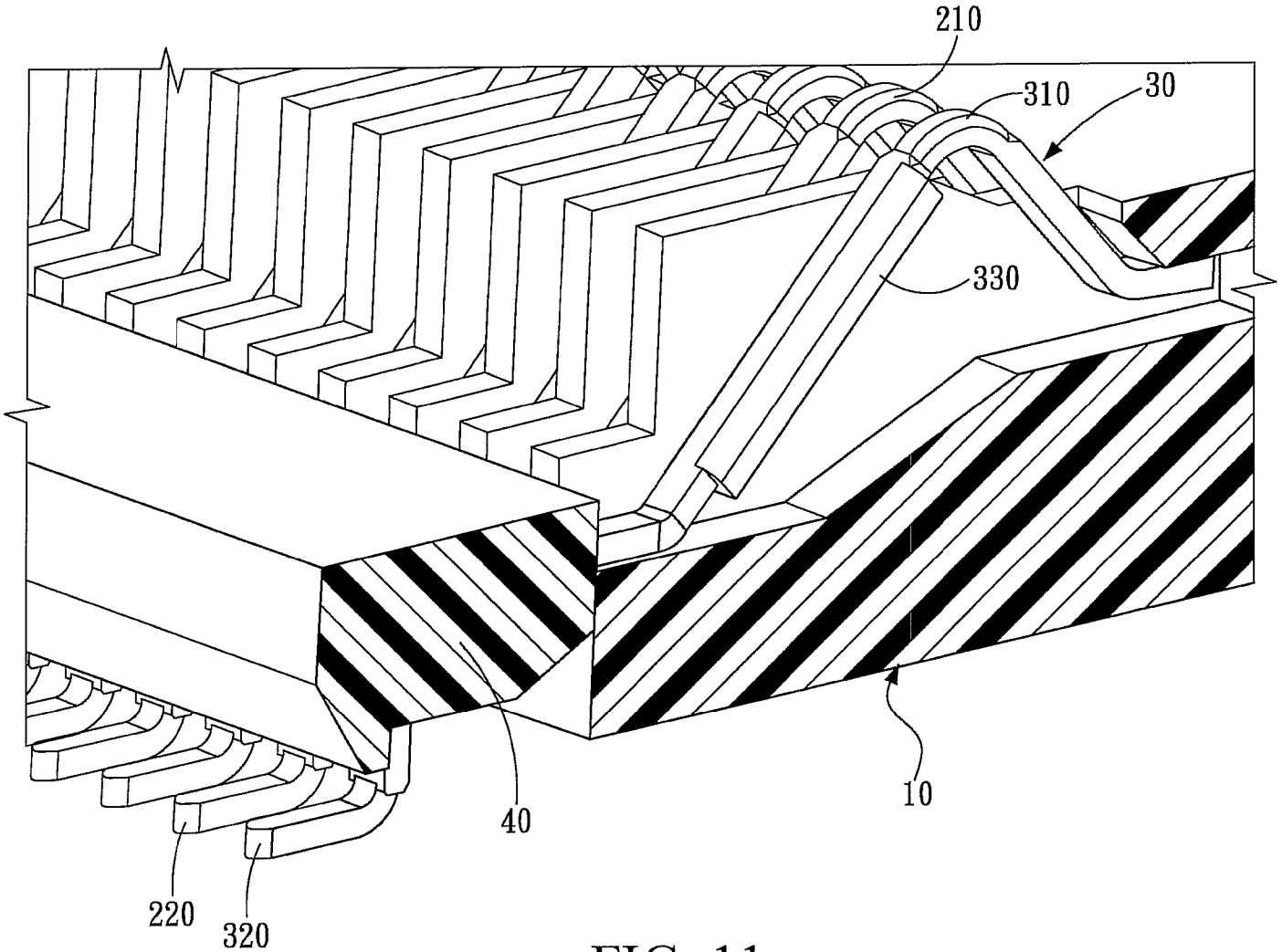
FIG. 11 is a schematic cross-sectional view of a fifth embodiment.
Figure 12:
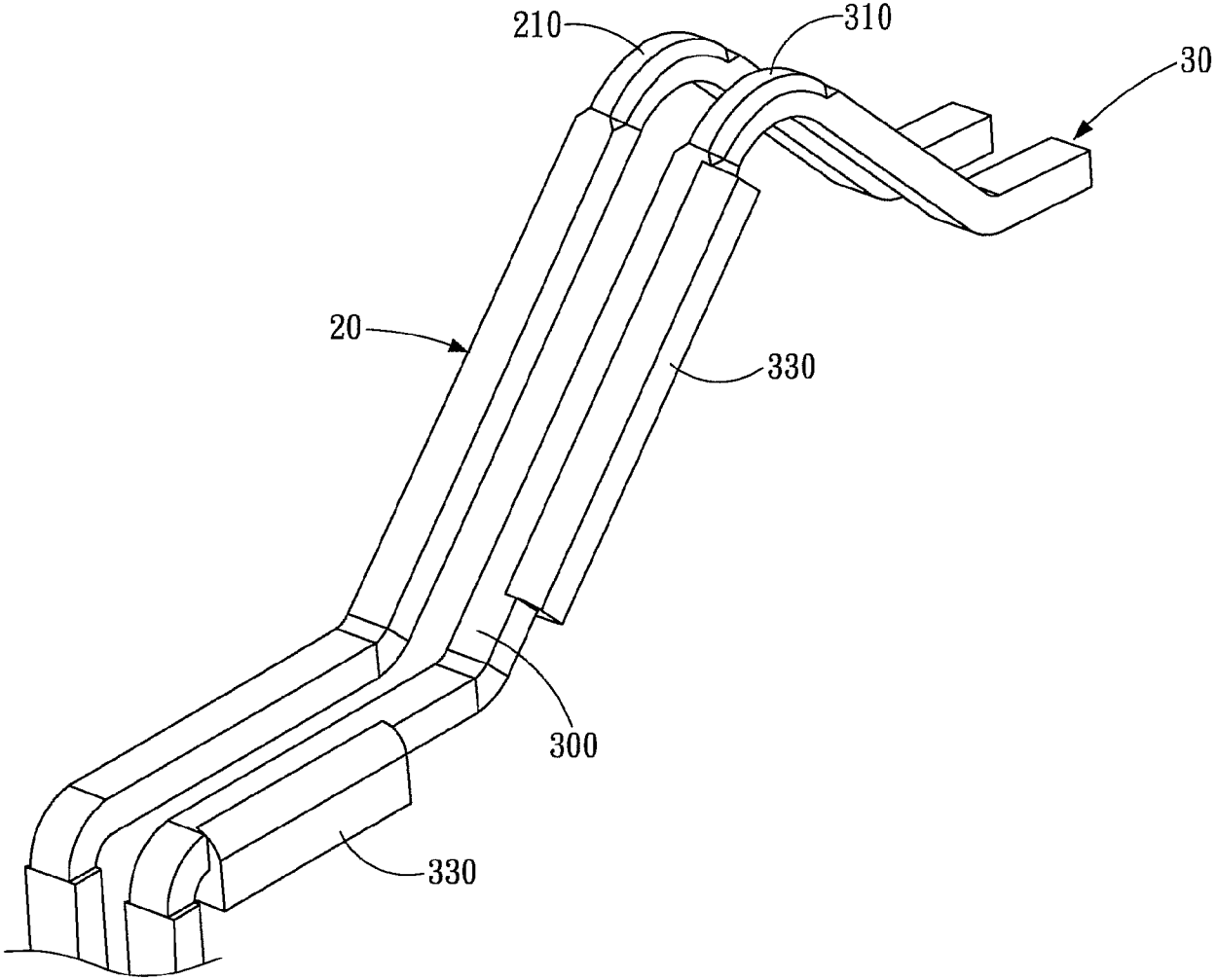
FIG. 12 is a perspective view of terminals in the fifth embodiment.

Please refer to FIG. 11 and FIG. 12, the first terminals 20 and second terminals 30 according to a fifth embodiment are shown, and different pin configurations as compared with the fourth embodiment are provided. The structure and the constitution of the first terminals 20 and the second terminals 30 of this embodiment are substantially the same as those of the fourth embodiment. The first terminal 20 includes a contact end 210 and a first welding end 220, and the second terminal 30 includes a body 300, a connection end 310, a second welding end 320 and a first extended portion 330.

While this disclosure has been described by the way of example and in terms of the preferred embodiments, it is to be understood that the invention need not to be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An anti-electromagnetic interference electrical connector, comprising:

an electrical insulation case comprising a slot;

a plurality of signal terminals, disposed in the electrical insulation case, and each of the signal terminal respectively comprising a contact end located in the slot; and a plurality of ground terminals, disposed in the electrical insulation case; wherein the ground terminals and the signal terminals are arranged in a staggered manner, each of the ground terminals respectively comprises a body and a first extended portion, the body is located in the electrical insulation case, and the body comprises a connection end located in the slot;

wherein the first extended portion is plate-like, extends from one side surface of the body toward adjacent signal terminals and through the space between the signal terminal and the ground terminal, a comprised angle is acute and defined between a widest surface of the first extended portion and a longitudinal axis of the body, and the first extended portion isolates the ground terminal of which it is a part from the signal terminals which are adjacent by increasing a lateral projected area of the ground terminal so as to block electromagnetic interference of the signal terminal.

2. The anti-electromagnetic interference electrical connector as claimed in claim 1, wherein each of the ground terminals further comprises a second extended portion, extending from the body and another comprised angle is defined between a widest surface of the second extended portion and a longitudinal axis of the body.

3. The anti-electromagnetic interference electrical connector as claimed in claim 2, wherein the first extended portion and the second extended portion are bent in the same direction or opposite directions.

4. The anti-electromagnetic interference electrical connector as claimed in claim 3, further comprising a positioning member, disposed in the electrical insulation case for positioning and latching an electrical plug, wherein the electrical plug is provided to be inserted in the slot and electrically connected to the contact ends and the connection ends.

5. The anti-electromagnetic interference electrical connector as claimed in claim 1, wherein each of the signal terminals further comprises a first welding end to be welded on a circuit board.

6. The anti-electromagnetic interference electrical connector as claimed in claim 1, wherein each of the second terminals further comprises a second welding end to be welded on a circuit board.

7. A terminal assembly, comprising:

a fixing seat;

a plurality of signal terminals, fixed on the fixing seat, and each of the signal terminals comprising a contact end; and a plurality of ground terminals, fixed on the fixing seat; wherein the ground terminals and the signal terminals are arranged in a staggered manner, each of the ground terminals respectively comprises a body and a first extended portion, the first extended portion is plate-like, extends from one side surface of the body toward adjacent signal terminals and through the space between the signal terminal and the ground terminal, a comprised angle is acute and defined between a widest surface of the first extended portion and a longitudinal axis of the body, and the first extended portion isolates the ground terminal of which it is a part from the signal terminals which are adjacent by increasing a lateral projected area of the ground terminal so as to block electromagnetic interference of the signal terminal.

8. The terminal assembly as claimed in claim 7, wherein the fixing seat combines the signal terminals in an insert molding manner.

9. The terminal assembly as claimed in claim 7, wherein the fixing seat combines the ground terminals in an insert molding manner.

10. The terminal assembly as claimed in claim 7, wherein the first extended portion of the ground terminal is embedded in the fixing seat.

11. The terminal assembly as claimed in claim 7, wherein the ground terminal further comprises a second extended portion, extending from the body and another comprised angle is defined between a widest surface of the second extended portion and a longitudinal axis of the body.

12. The terminal assembly as claimed in claim 11, wherein the first extended portion and the second extended portion are bent in the same direction or opposite directions.

13. The anti-electromagnetic interference electrical connector as claimed in claim 1, wherein the first extended portion is within the electrical insulation case.

14. The terminal assembly as claimed in claim 7, wherein the first extended portion is fixed to the fixing seat.

* * * * *